US009421753B2

(12) United States Patent
Kang et al.

(10) Patent No.: US 9,421,753 B2
(45) Date of Patent: Aug. 23, 2016

(54) PRINTING APPARATUS AND METHOD FOR MEASURING AND COMPENSATING FOR SYNCHRONIZATION ERROR

(71) Applicant: KOREA INSTITUTE OF MACHINERY & MATERIALS, Daejeon (KR)

(72) Inventors: Dong Woo Kang, Daejeon (KR); Taik Min Lee, Daejeon (KR); In Young Kim, Daejeon (KR); Young Man Choi, Daejeon (KR); Seung-Hyun Lee, Daejeon (KR); Deok Kyun Yoon, Daejeon (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 228 days.

(21) Appl. No.: 14/068,183

(22) Filed: Oct. 31, 2013

(65) Prior Publication Data

US 2014/0196619 A1 Jul. 17, 2014

(30) Foreign Application Priority Data

Jan. 16, 2013 (KR) ..... 10-2013-0004925

(51) Int. Cl.

| | |
|---|---|
| ***B41F 3/36*** | (2006.01) |
| ***B41M 1/26*** | (2006.01) |
| ***B41F 13/12*** | (2006.01) |
| ***B41F 3/82*** | (2006.01) |
| ***B41F 33/14*** | (2006.01) |

(52) U.S. Cl.

CPC . *B41F 13/12* (2013.01); *B41F 3/82* (2013.01); *B41F 33/14* (2013.01); *B41M 1/26* (2013.01); *B41P 2213/90* (2013.01)

(58) Field of Classification Search

CPC ..... B41F 3/36; B41F 3/82; B41F 9/00; B41F 9/01; B41F 13/12; B41F 13/14; B41F 33/06; B41F 33/08; B41F 33/14; B41M 1/10; B41M 1/26; B41M 1/34; B41P 2213/90; B65H 5/04

USPC ..... 101/158, 163, 170, 484

See application file for complete search history.

(56) References Cited

U.S. PATENT DOCUMENTS 5,367,953 A * 11/1994 Yamashita ..... B41F 1/16 101/158

FOREIGN PATENT DOCUMENTS

| | | |
|---|---|---|
| JP | 2004-058536 | 2/2004 |
| JP | 2010-241069 | 10/2010 |
| JP | 2011-037239 | 2/2011 |
| JP | 2011-173393 | 9/2011 |
| KR | 10-2009-0127657 | 12/2009 |

* cited by examiner

*Primary Examiner* — Leslie J Evanisko

(74) *Attorney, Agent, or Firm* — Lex IP Meister, PLLC

(57) ABSTRACT

A printing apparatus for measuring and compensating for a synchronization error is provided. The printing apparatus includes: a rotating part configured to include a roll of which the surface is made of a flexible material and a motor rotating the roll; a support part having a substrate disposed on an upper portion thereof to support the substrate and formed to relatively move in a direction parallel with a tangential direction of the rotating part and the roll; a printing pressure part formed to provide adhesion and printing pressure of the roll to the substrate by changing an interval between the rotating part and the support part; and a compensation unit configured to include a sensor unit which is disposed on a lower portion of the substrate to measure forces which are applied between the roll and the substrate at a contact position between the roll and the substrate and a control unit which performs a control to compensate for the synchronization error by using values of forces measured by the sensor unit.

23 Claims, 20 Drawing Sheets

PRINTING APPARATUS AND METHOD FOR MEASURING AND COMPENSATING FOR SYNCHRONIZATION ERROR

CROSS-REFERENCE TO RELATED APPLICATION

This application claims priority to and the benefit of Korean Patent Application No. 10-2013-0004925 filed in the Korean Intellectual Property Office on Jan. 16, 2013, the entire contents of which are incorporated herein by reference.

BACKGROUND OF THE INVENTION (a) Field of the Invention

The present invention relates to a printing apparatus and method for measuring and compensating for a synchronization error.

A lithography technology has been widely used in a technology of manufacturing electronic devices according to the related art. However, in performing an actual process using the lithography technology, various and complicated detailed processes, such as vacuum deposition, exposure, developing, plating, and etching, are required, which leads to a problem in that a process design and an apparatus configuration may be complicated, and the like. Further, due to the development of a micro technology in various fields, a method for manufacturing an integrated circuit using other technologies other than using the photo lithography technology has been sought.

Electronic printing is a technology of manufacturing electronic devices by simply performing a printing process. Since the electronic printing may basically remove process complexity involved in the photo lithography process by replacing the foregoing photo lithography process, research into the electronic printing having applications expanded to various fields, and the like, has been actively conducted recently. As the recently available printing technology, there are a contactless type printing technology and a contact type printing technology. A representative example of the contactless type printing technology may include inkjet, spray, slot die coating, and the like and a representative example of the contact type printing technology may include gravure, gravure offset, reverse offset, screen printing, and the like.

Meanwhile, in a recent technology of manufacturing a semiconductor, a case in which a film type substrate of a flexible material, not a substrate of a hard material, is used has increased. In the case of using the film type substrate, a process speed is increased, and thus mass production may be achieved. In this case, since production efficiency may be increased when a roll-to-roll production method is combined with the electronic printing technology as described above, a study of a combination of the roll-to-roll production method and the electronic printing technology has been very actively conducted.

The contactless type printing technology is appropriate to perform printing based on a type of uniformly coating a wide area. However, in order to form a fine pattern, the contact type printing technology, such as gravure and reverse offset, is mainly used. In the contact type printing technology, a roll is frequently used to perform a continuous process. That is, patterns to be printed are formed on the roll and the patterns on the roll are transferred to the substrate, thereby performing the printing. The contact type printing technology may be applied to both of the substrate of a hard material and the substrate of a flexible material. In the case of the substrate of a hard material, the roll contacts the substrate disposed on a stage and in the case of the substrate of a flexible material, the roll contacts another roll or contacts the flexible substrate which is supported by another flat type support part. Except for the substrate, in the former case, it is considered that the roll may contact the stage and in the latter case, it is considered that the roll may contact the roll or the roll may contact the flat type support part.

(b) Description of the Related Art

In the contact type electronic printing using the roll, a rotating velocity of the roll needs to be well synchronized with a movement velocity of the substrate support part supporting the substrate. When the synchronization is not properly made, problems, such as sliding of the roll, occur, such that the patterns may not be correctly printed on the substrate.

In order to synchronize the rotating velocity of the roll with the movement velocity of the substrate support part, a product of a radius of the roll and an rotating angular velocity of the roll needs to be the same as a linear movement velocity of the substrate support part. However, the radius of the roll is changed since a surface of the roll is actually made of a flexible material, such as rubber, and the printing job is performed while the roll applies printing pressure to the substrate, that is, the roll is pressed at the printed position. Therefore, even though the product of the radius of the roll which is not deformed and the rotating angular velocity of the roll is equal to the linear movement velocity of the substrate support part, the synchronization error between the roll and the substrate occurs due to the change in the radius of the roll at the time of the actual printing job.

Various technologies for compensating for an error in the contact type printing according to the related art are disclosed. Korean Patent No. 0981278 ("Printing apparatus of flexible electronic devices available for alignment error compensation on roll and board and printing method thereof", Sep. 3, 2010), Japanese Patent Laid-Open Publication No. 2011-173393 ("Printing roll and plate, apparatus for compensating for tilt of print", Sep. 8, 2011), Japanese Patent Laid-Open Publication No. 2011-037239 ("Method and apparatus for compensating for error at printed position", Feb. 24, 2011), and the like, disclose a technology of compensating for various errors to align printed positions, but may never compensate for the synchronization error between the roll and the substrate support part as described above. Japanese Patent Laid-Open Publication No. 2004-058536 ("Synchronous compensation apparatus", Feb. 26, 2004) discloses a technology of compensating for error occurring due to sliding between the roll and the substrate and is to control a rotation of a holder, and the like by detecting whether running paper is correctly transferred in a rotary press by a leading edge detector, but does not have a solution of a synchronization error problem between the roll and the substrate support part as described above by never considering the case in which the radius of the roll is changed.

As such, the related art does not have a solution of compensating for the synchronization error between the roll and the substrate support part occurring due to a deformation, and the like, which is caused by the printing pressure of the roll at the time of the electronic printing, thereby greatly limiting the improvement in printing precision.

RELATED ART DOCUMENT

Patent Document

1. Korean Patent No. 0981278 ("Printing Apparatus of Flexible Electronic Devices Available for Alignment Error Compensation on Roll and Board and Printing Method Thereof", Sep. 3, 2010)

2. Japanese Patent Laid-Open Publication No. 2011-173393 ("Printing Roll and Plate, Apparatus for Compensating for Tilt of Print", Sep. 8, 2011)

3. Japanese Patent Laid-Open Publication No. 2011-037239 ("Method and Apparatus for Compensating for Error at Printed Position", Feb. 24, 2011)

4. Japanese Patent Laid-Open Publication No. 2004-058536 ("Synchronous Compensation Apparatus", Feb. 26, 2004)

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a printing apparatus and method for measuring and compensating for a synchronization error which may compensate for the synchronization error between a roll and a substrate support part occurring due to a deformation, and the like which is caused by a printing pressure of the roll at the time of electronic printing.

An exemplary embodiment of the present invention provides a printing apparatus for measuring and compensating for a synchronization error, including: a rotating part configured to include a roll of which the surface is made of a flexible material and a motor rotating the roll; a support part having a substrate disposed on an upper portion thereof to support the substrate and formed to relatively move in a direction parallel with a tangential direction of the rotating part and the roll; a printing pressure part formed to provide adhesion and printing pressure of the roll to the substrate by changing an interval between the rotating part and the support part; and a compensation unit configured to include a sensor unit which is disposed on a lower portion of the substrate to measure forces which are applied between the roll and the substrate at a contact position between the roll and the substrate and a control unit which performs a control to compensate for the synchronization error by using values of forces measured by the sensor unit.

The sensor unit may measure a force applied in a tangential direction of the roll among the forces applied between the roll and the substrate.

The compensation unit may perform the control by compensating for at least one selected from a rotating velocity (ω) of the motor and a relative movement velocity (V) between the rotating part and the support part. The compensation unit may perform a feedback control on at least one selected from the rotating velocity (ω) of the motor and the relative movement velocity (V) between the rotating part and the support part so that the force applied in the tangential direction of the roll becomes 0.

The sensor unit may further measure at least one selected from a force applied in a radial direction of the roll and a force applied in an extending direction of the roll among the forces applied between the roll and the substrate. The compensation unit may control the support part to further compensate for at least one selected from tilting, bending, and alignment between the rotating part and the support part.

The compensation unit may be configured to further include an additional stage which is disposed on the support part so as to have the substrate disposed on an upper portion thereof. The compensation unit may perform the control by compensating for at least one selected from the rotating velocity (ω) of the motor and the relative movement velocity (V) between the rotating part and the support part and a displacement or a velocity of the additional stage.

The sensor unit may further measure at least one selected from a force applied in a radial direction of the roll and a force applied in an extending direction of the roll among the forces applied between the roll and the substrate. The compensation unit may control at least one selected from the support part and the additional stage so as to further compensate for at least one selected from the tilting, the bending, and the alignment between the rotating part and the support part.

The sensor unit may measure at least one selected from the force applied in the radial direction of the roll and the force applied in the extending direction of the roll among the forces applied between the roll and the substrate. The compensation unit may control at least one selected from the rotating velocity (ω) of the motor and the relative movement velocity (V) between the rotating part and the support part depending on lookup table data which is previously stored in the control unit. The lookup table may be stored with data which represent the relationship between variables of at least two variables selected from a pressure applied by the printing pressure part, a radius (R) of the roll, the rotating velocity (ω) of the motor, an angle (θ) of the roll, the relative movement velocity (V) between the rotating part and the support part, and a relative displacement (x) between the rotating part and the support part.

The sensor unit may be configured of a 6-axis sensor.

The sensor unit may include: a guide part connected to the support part so as to have the substrate disposed thereon and allowed to move only in a direction parallel with a relative movement direction between the rotating part and the support part; and a measurement unit configured to include a displacement sensor or a load cell which is disposed at an end parallel with a movement direction of the guide part to measure a value of a displacement or a force depending on the movement of the guide part.

The guide part may have a flexure structure or a rolling bearing structure.

The printing apparatus for measuring and compensating for a synchronization error may include: a guide part configured to include a disposition part having the substrate disposed thereon, a link part disposed at a lower end of the disposition part to connect the disposition part to the support part, and a hinge part disposed at a point which the link part is connected to the disposition part or the support part and formed to rotate in a direction parallel with the relative movement direction between the rotating part and the support part.

The printing apparatus for measuring and compensating for a synchronization error may include: a guide part configured to include a disposition part having the substrate disposed thereon, a link part disposed at a lower end of the disposition part to connect the disposition part to the support part, and a notch part disposed at a point which the link part is connected to the disposition part or the support part and formed to be depressed in a direction parallel with the relative movement direction between the rotating part and the support part.

The printing apparatus for measuring and compensating for a synchronization error may include: a guide part configured to include a disposition part having the substrate disposed thereon, a plurality of connection parts fixedly disposed on the support part, and a plate spring part disposed at a point which the disposition part is connected to the connection part and formed to be bent in a direction parallel with the relative movement direction between the rotating part and the support part.

The printing apparatus for measuring and compensating for a synchronization error may include: a guide part configured to include a disposition part having the substrate disposed thereon and a rolling bearing disposed between the support part and the disposition part.

The support part may be formed in a flat type stage form supporting a flat type substrate, a roll form supporting a flexible substrate, or a flat type stage form supporting the flexible substrate.

Another exemplary embodiment of the present invention provides a printing method for measuring and compensating for a synchronization error using a printing apparatus configured to include a rotating part including a roll and a motor, a support part having a substrate disposed on an upper portion thereof to support the substrate, a printing pressure part changing an interval between the rotating part and the support part, and a compensation unit including a sensor unit which is disposed on a lower portion of the substrate to measure a force in at least one direction applied in a tangential direction of the roll among forces which are applied between the roll and the substrate at a contact position between the roll and the substrate and a control unit which controls at least one selected from a rotating velocity (ω) of the motor and a relative movement velocity (V) between the rotating part and the support part to compensate for the synchronization error using the valued of the force measured by the sensor unit, the printing method including: performing a feedback control on at least one selected from the rotating velocity (ω) of the motor and the relative movement velocity (V) between the rotating part and the support part so that the force applied in the tangential direction of the roll becomes 0.

The printing method for measuring and compensating for a synchronization error may include: receiving, by the control unit, at least one selected from the rotating velocity (ω) of the motor applied to the motor and the relative movement velocity (V) between the rotating part and the support part applied to the rotating part or the support part (S1); measuring, by the sensor unit, a force F applied in the tangential direction of the roll (S2); calculating, by the control unit, the compensation value of the rotating velocity (ω) of the motor or the relative movement velocity (V) between the rotating part and the support part by using a value of the force measured by the sensor unit and a previously stored friction model (S3); and applying the compensation value of the rotating velocity (ω) of the motor calculated in the step S3 to the motor or the compensation value of the relative movement velocity V between the rotating part and the support part calculated in the step S3 to the rotating part or the support part, by the control unit (S4).

According to the exemplary embodiments of the present invention, it is possible to compensate for the synchronization error between the roll and the substrate support part occurring due to the deformation, and the like which is caused by the printing pressure of the roll at the time of the electronic printing. Describing in more detail, the surface of the roll used for the electronic printing is made of a material having flexibility and elasticity such as rubber, the patterns formed on the roll by the electronic printing ink are transferred onto the substrate by the printing pressure to perform the printing of the patterns on the substrate. Since the radius of the roll is changed during this process, the synchronization between a tangential velocity at the printed position which is calculated by the original radius and a rotating angular velocity of the roll prior to the change in the radius of the roll and the linear movement velocity of the substrate support part is not performed, thereby causing the synchronization error. The related art does not have the method of compensating for a synchronization error, thereby greatly limiting the improvement in the printing precision.

According to the exemplary embodiments of the present invention, it is possible to finely compensate for the synchronization error by performing the active compensation which measures the synchronization error and performs a feedback control on the rotating velocity or the roll or the movement velocity of the substrate support part by using the friction force of the tangential direction at the printed position. According to the exemplary embodiments of the present invention, it is possible to remarkably improve the printing precision over the related art, by compensating for the synchronization error.

DETAILED DESCRIPTION OF THE EMBODIMENTS

Hereinafter, a printing apparatus and method for measuring and compensating for a synchronization error according to exemplary embodiments of the present invention will be described in detail with reference to the accompanying drawings.

First, a synchronization error occurring at the time of electronic printing will be described in more detail.

Figure 1:
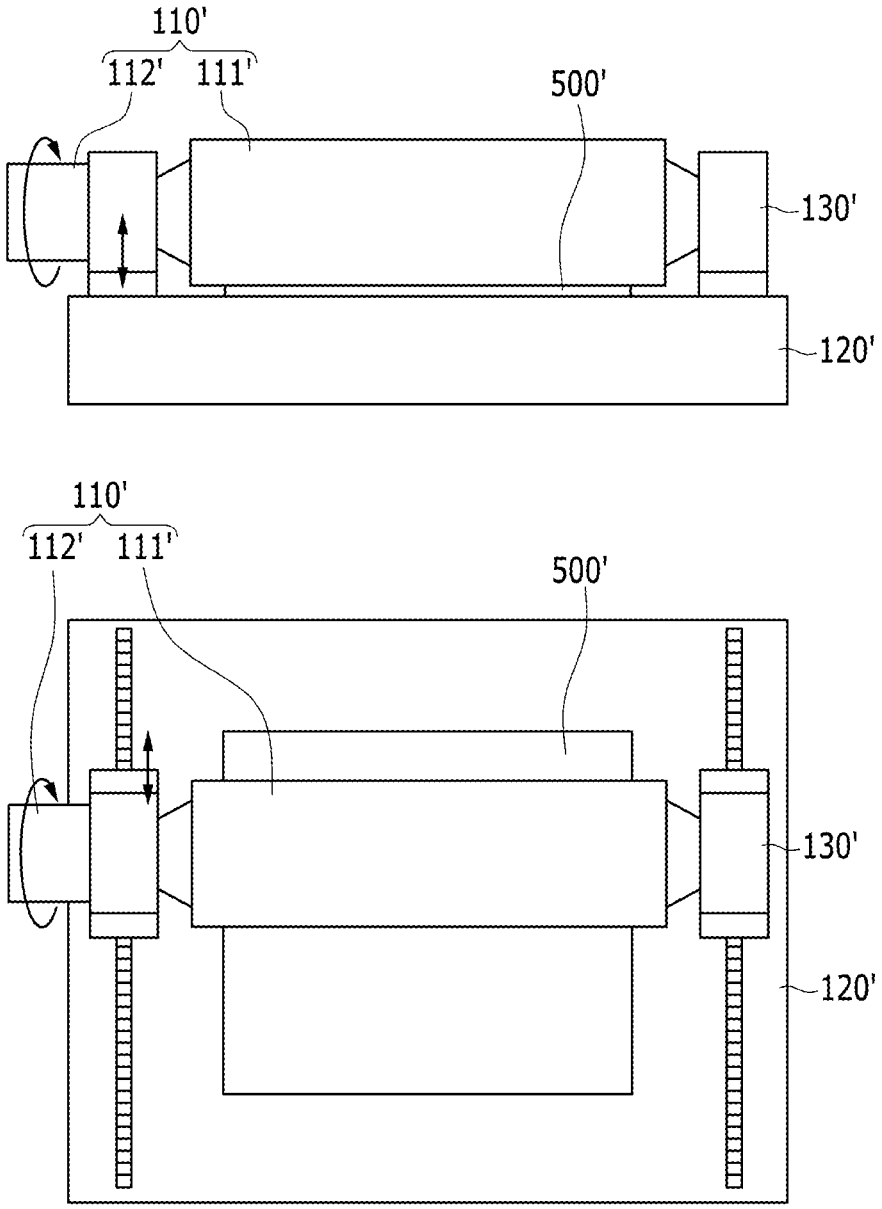
FIG. 1 (Prior Art)
FIG. 1 is a diagram illustrating a structure of a contact type printing apparatus using a general roll according to the related art.

FIG. 1 illustrates a structure of a contact type printing apparatus using a general roll according to the related art. As illustrated in FIG. 1, the contact type printing apparatus using the general roll is configured to include a rotating part 110' which includes a roll 111' and a motor 112', a support part 120' which supports a substrate 500', and a printing pressure part 130' which is configured to vertically move the rotating part 110' to apply the printing pressure to the roll 111' on the substrate 500' which is disposed on the support part 120'. FIG.

1 illustrates an example in which the support part 120' has a stage form and in this case, the substrate 500' is made of a hard material. Meanwhile, when the substrate 500' is made of a flexible material, the support part 120' may have a roll form, and the like, and therefore the form of the support part 120' is not necessarily limited to the stage form. Briefly describing a printing principle, the roll 111' presses the substrate 500' by allowing the printing pressure part 130' to drop in the state in which patterns are formed on the roll 111' by electronic printing ink. In this state, the roll 111' rotates and the support part 120' relatively moves at a velocity synchronized with the rotation of the roll, such that the patterns on the roll 111' are transferred onto the substrate 500', thereby performing the pattern printing on the substrate 500'. In this case, as illustrated in an example of FIG. 1, the roll 111' linearly moves simultaneously with the rotation of the roll 111', such that a relative movement between the rotating part 110' and the support part 120' may be performed, but the exemplary embodiment of the present invention is not limited thereto.

Alternatively, the rotating part 110' only rotates the roll 111' and the support part 120' directly moves, such that the relative movement between the rotating part 110' and the support part 120' may be made. Therefore, only if the relative movement between the rotating part 110' and the support part 120' is made, any one thereof may be formed to move.

Figure 2A:
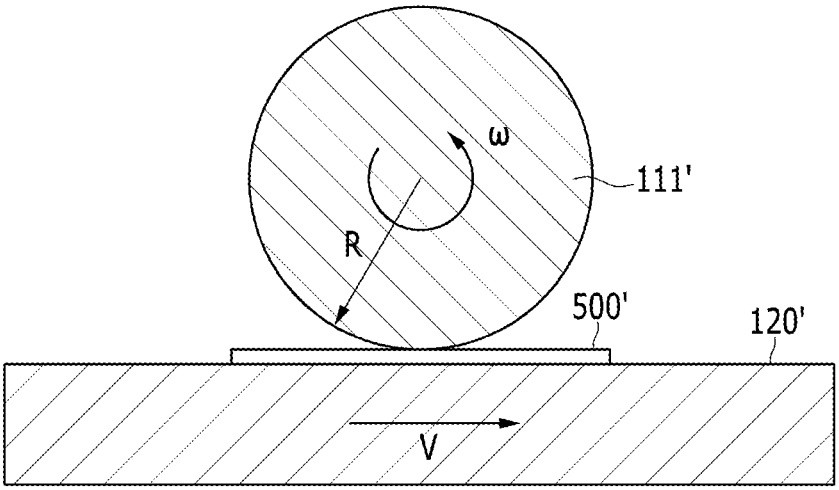
FIGS. 2A and 2B are diagrams illustrating a principle of synchronization error occurrence between a rotation of a roll and a relative movement of a substrate.
Figure 2B:
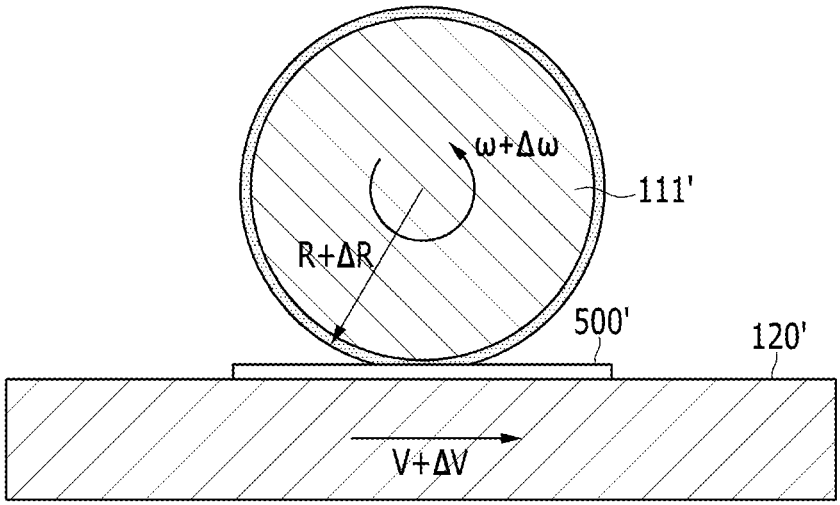

FIGS. 2A and 2B illustrate a principle of synchronization error occurrence. FIG. 2A illustrates an ideal case. When the roll 111', which is a rigid body, has a fixed radius R, a rotating velocity of the roll 111' by the motor 112' is constantly maintained at co, and a relative movement velocity to the roll 111' of the support part 120' is constantly maintained at V, Rω is set to be equal to V, thereby implementing the ideal synchronization.

Actually, however, as described and illustrated in FIG. 2B, a surface of the roll 111' is made of a flexible material, such as rubber and the shape of the roll 111' may be deformed at a printed position while the printing pressure part 130' presses the rotating part 110' and the substrate 500'. That is, the radius of the roll 111' becomes R+ΔR, and since the rotation of the motor 112' or the movement of the support part 120' is not also constantly maintained ideally actually at all times, the rotating velocity becomes ω+Δω and the movement velocity becomes V+ΔV. Therefore, the synchronization error as much as (R+ΔR) (ω+Δω))−(V+ΔV) essentially occurs.

Among those, in particular, the change in the radius of the roll 111' leads to the fatal error to the synchronization. The ΔR may include variations in the radius of the roll 111' by a mechanical error, such as the alignment of a rotation axis and the flatness of the support part 120'. According to the related art, various researches for improving a printing quality have been conducted, but there is no research for solving the problem of the synchronization error which occurs due to a difference in the relative movement between the rotating part 110' and the support part 120'. However, the effect of the synchronization error on the printing quality may not be ignored. Actually, in the generally used electronic printing apparatus, as a result of simulating how much error occurs at the time of performing the control under the assumption that the roll is not pressed in the state in which the roll is pressed, it is found that an error of about 10 μm may occur. In the fine pattern printing process, the error is a big error which may not perform the pattern printing. For example, in the case of printing the pattern having a line width having about 1 μm, however large the error occurring in the printing apparatus is, the error needs to be smaller than 1 p.m. As such, when the printing is performed by the printing apparatus which may cause the error of about 10 μm, it is almost impossible to perform the printing at a desired quality. For this reason, the problem in that the printing precision is greatly restricted in the electronic printing has been continuously present.

The present invention discloses the printing apparatus and method for measuring and compensating for a synchronization error to solve the synchronization error problem.

Figure 3:
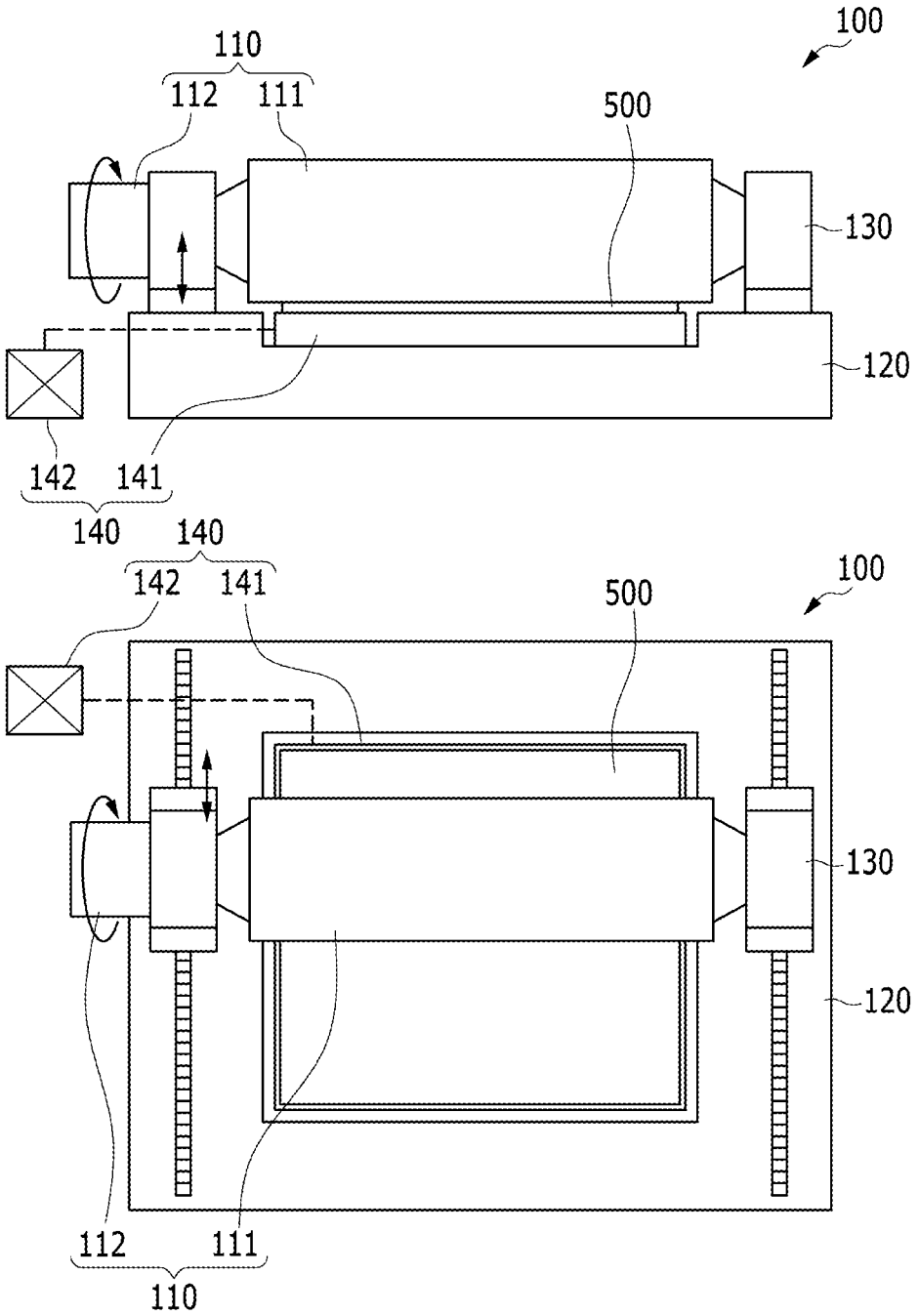
FIG. 3 is a diagram illustrating a printing apparatus according to a first exemplary embodiment of the present invention.

FIG. 3 illustrates a printing apparatus for measuring and compensating for a synchronization error according to an exemplary embodiment of the present invention. A printing apparatus 100 for measuring and compensating for a synchronization error according to the exemplary embodiment of the present invention is configured to include a rotating part 110, a support part 120, a printing pressure part 130, and a compensation unit 140. In other words, the rotating part 110, the support part 120, and the printing pressure part 130 are the same as each component in the electronic printing apparatus according to the related art, that is, the printing apparatus 100 according to the exemplary embodiment of the present invention is an apparatus for ultimately performing the electronic printing while measuring and compensating for the synchronization error. Hereinafter, each component will be described.

The rotating part 110 is configured to include a roll 111 of which the surface is made of a flexible material and a motor 112 rotating the roll 111. As described above, in the case of using the contact type printing technology in the electronic printing, the printing is performed by forming patterns on the surface of the roll 111 by the electronic printing ink and then pressing the patterns on the substrate 500. Therefore, it is well known that the surface of the roll 111 is generally made of a flexible material, such as rubber and PDMS.

The support part 120 has the substrate 500 disposed on an upper portion thereof to support the substrate 500 and is formed to relatively move in a direction parallel with a tangential direction of the rotating part 110 and the roll 111. By allowing the support part 120 to relatively move in a direction parallel with the tangential direction of the roll 111, the substrate 500 moves by the rotation of the roll 111, such that the patterns on the roll 111 may be printed by being smoothly transferred onto the substrate 500.

FIG. 3 illustrates an example in which the support part 120 has a flat type stage form to allow the patterns to be printed on a flat type substrate of a hard material, the support part 120 is fixed, and the rotating part 110 is movably formed on the support part 120. However, the exemplary embodiment of the present invention is not limited thereto, and therefore the rotating part 110 is fixed, but the support part 120 may be formed to move the substrate 500 by including a separate actuator, and the like, or both of the rotating part 110 and the support part 120 may be movably formed. Further, FIG. 3 illustrates an example in which the support part 120 has a flat type stage form. However, when the printing is performed on a flexible substrate, the support part 120 may have a roll form or may have a form in which the support part 120 support the flexible substrate and rolls are disposed at both sides of the printed position of the flexible substrate and the flexible substrate is supported at the printed position portion by the flat type stage, and the like. Therefore, any of the available substrate support structures may be adopted as the support part 120.

The printing pressure part 130 is formed to provide the adhesion and printing pressure of the roll 111 to the substrate 500 by changing an interval between the rotating part 110 and the support part 120. That is, the printing pressure part 130 drops the roll 111 to press the roll onto the substrate 500. In this state, the printing is performed on the substrate 500 by rotating the roll 111.

When the printing job is not performed, for example, at the time when the vacant substrate 500 to be printed is disposed on the support part 120, and the like, the printing pressure part 130 also allows the roll 111 to rise, thereby securing a sufficient job space.

Figure 4:
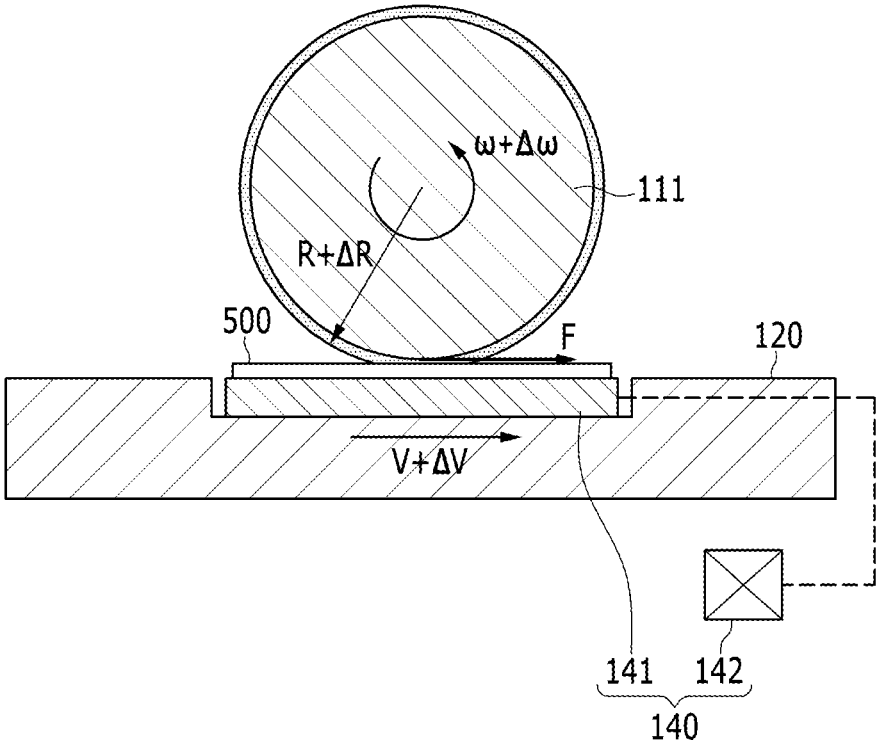
FIG. 4 is a partially detailed diagram illustrating the printing apparatus according to the first exemplary embodiment of the present invention.

The compensation unit 140, which is the most important component according to the exemplary embodiment of the present invention, measures and compensates for the synchronization error. The compensation unit 140 is basically configured to include a sensor unit 141 and a control unit 142 as illustrated in FIG. 3. FIG. 4 is a cross-sectional view illustrating in detail a deposition structure of the compensation unit 140.

First, as illustrated in FIG. 4, the sensor unit 141 is disposed on a lower portion of the substrate 500 to measure forces which are applied between the roll 111 and the substrate 500 at a contact position between the roll 111 and the substrate 500. Among the forces applied between the roll 111 and the substrate 500, a force applied in a tangential direction of the roll 111 is a friction force. If there is no synchronization error between the rotating part 110 and the support part 120, the friction force may not occur between the roll 111 and the substrate 500. However, when the synchronization error occurs, a phenomenon that the roll 111 is pushed or the substrate 500 is pushed occurs. In this case, the friction force is generated. Describing in more detail, as illustrated in FIG. 4, since the surface of the roll 111 is made of a flexible material, the radius of the roll 111 is changed (R+ΔR) while the printing is performed by allowing the roll 11 to press the substrate 500. Further, comparing with the rotating velocity (ω) or the movement velocity (V) actually applied, the rotating velocity ω of the motor 112 or the relative movement velocity (V) between the rotating part 110 and the support part 120 may also lead to an error (ω+Δω)/V+ΔV) due to disturbance. Therefore, when the synchronization error of (R+ΔR) (ω+Δω)−(V+ΔV) between the roll 111 and the substrate 500 occurs at the printed position, the roll 111 or the substrate 500 is pushed by the synchronization error, thereby generating the friction force F. According to the exemplary embodiment of the present invention, the friction force F is used to measure and compensate for whether the synchronization error between the rotating part 110 and the moving part 120 occurs.

In this case, the friction force may be measured to be directly used for compensation and other physical quantities associated with the friction force may be measured to be used for compensation. Further, an object to be compensated may also directly compensated in the rotating velocity (ω) of the motor 112 or the relative movement velocity (V) between the rotating part 110 and the support part 120 but may also compensated in other physical quantities associated therewith. For example, as illustrated in FIG. 4, the control unit 142 performs a control to compensate for the synchronization error by using values of the forces measured by the sensor unit 141, in which in order to compensate for the synchronization error, only the rotating velocity (ω) of the motor 112 may be compensated, only the relative movement velocity (V) between the rotating part 110 and the support part 120 may be compensated for, or both of them may be compensated for. This compensation may be implemented only by appropriately determining a control model but may be implemented by selecting any variable depending on a user demand. As described above, various exemplary embodiments from a principle of the present invention may be possible. Hereinafter, each exemplary embodiment of the present invention will be described separately.

First Exemplary Embodiment

According to the first exemplary embodiment of the present invention, the sensor unit 141 measures the force applied in the tangential direction of the roll 111 among the forces applied between the roll 111 and the substrate 500 so that the compensation unit 140 compensates for and controls at least one selected from the rotating velocity (ω) of the motor 112 and the relative movement velocity (V) between the rotating part 110 and the support part 120.

This will be described below in more detail. According to the first exemplary embodiment of the present invention, when the synchronization error occurs between the rotating part 110 and the support part 120, the force applied in the tangential direction of the roll 111, that is, the friction force F is generated at the printed position (that is, a contact position between the roll 111 and the substrate 500). The compensation unit 140 controls at least one selected from the rotating velocity (ω) of the motor 112 and the relative movement velocity (V) between the rotating part 110 and the support part 120 to set the friction force to 0, thereby compensating for the synchronization error.

Figure 5A:
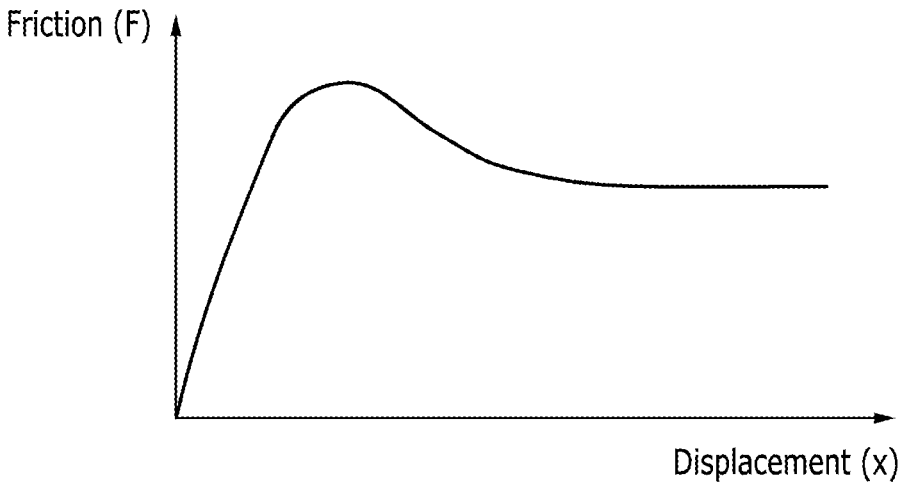
FIGS. 5A and 5B are graphs illustrating a relationship between friction force and relative displacement/friction force and relative velocity.
Figure 5B:
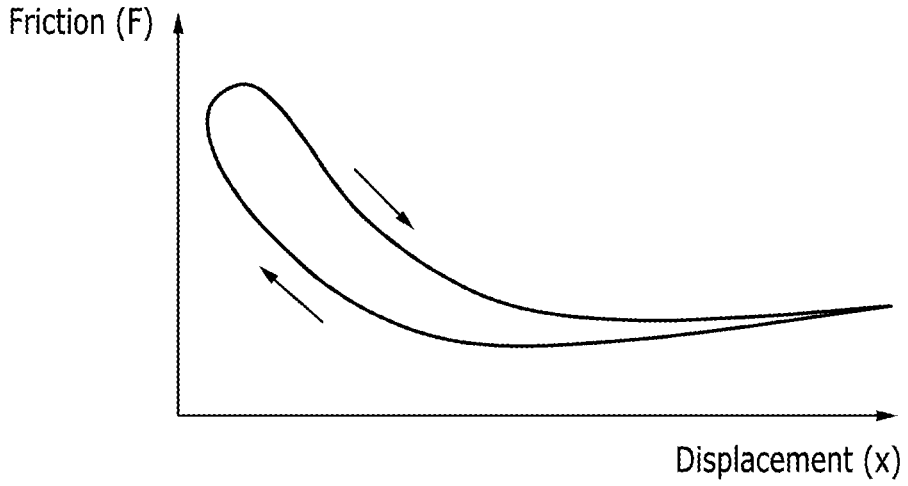

FIGS. 5A and 5B illustrate a relationship graph between the friction force (F) and the relative displacement (x) between the rotating part 110 and the support part 120 (FIG. 5A) and a relationship graph between the friction force (F) and the relative moving speed (V) between the rotating part 110 and the support part 120 (FIG. 5B). As illustrated in FIGS. 5A and 5B, a friction model may be made by modeling the relationship between the friction force (F) and the synchronization error, such that the compensation unit 140 uses the friction model for a feedback control to compensate for the synchronization error.

Figure 6A:
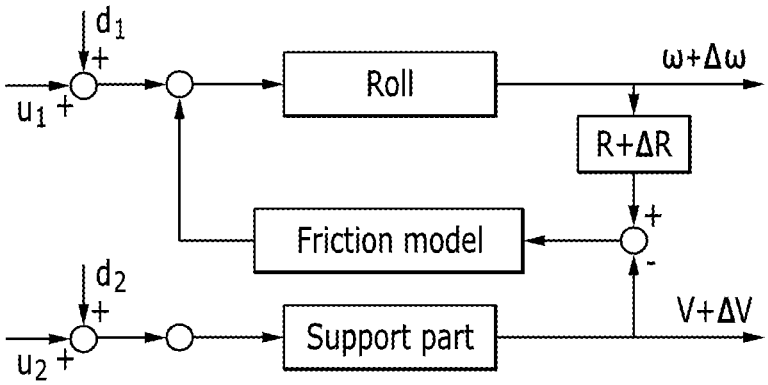
FIGS. 6A to 6C are block diagrams illustrating a printing method according to a first exemplary embodiment of the present invention.
Figure 6B:
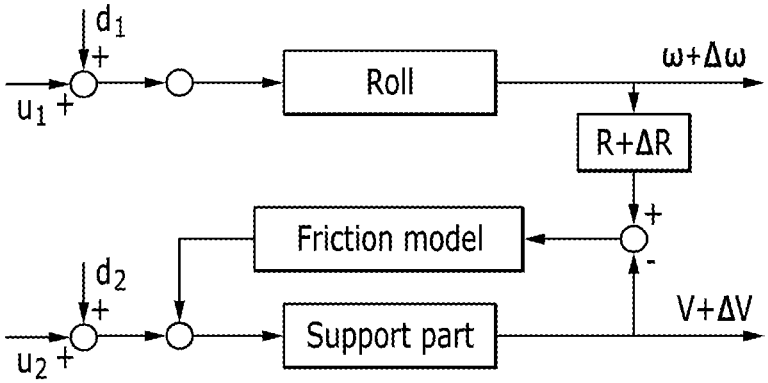
Figure 6C:
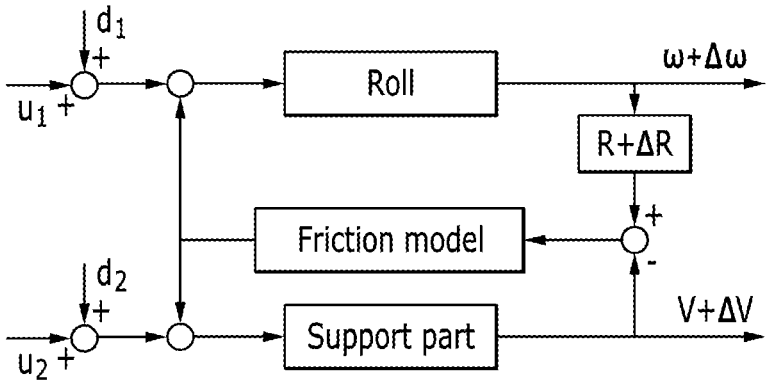
Figure 7:
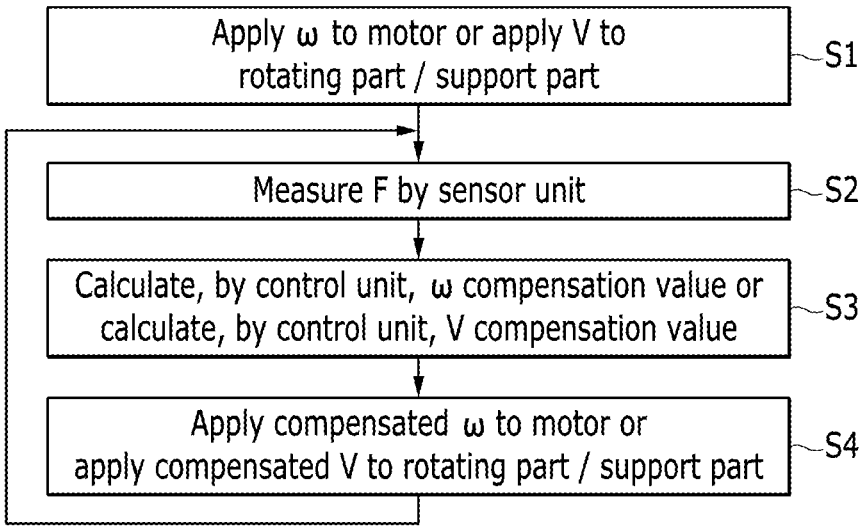
FIG. 7 is a flow chart illustrating the printing method according to the exemplary embodiment of the present invention.

FIGS. 6A to 6C illustrate examples of various feedback controls using the friction model. FIG. 6A illustrates an example of the feedback control which compensates for only the rotating velocity (ω), FIG. 6B illustrates an example of the feedback control which compensates for only the movement velocity (V), and FIG. 6C illustrates an example of the feedback control which compensates for both of the rotating velocity (ω) and the movement velocity (V). Further, FIG. 7 illustrates a flow chart of a printing method for measuring and compensating for a synchronization error by the feedback control. The printing method according to the exemplary embodiment of the present invention will be described in detail below with reference to FIGS. 6A to 6C and 7.

First, as illustrated in FIG. 7, the control unit 142 receives at least one selected from the rotating velocity (ω) of the motor 112 applied to the motor 112 and the relative movement velocity (V) between the rotating part 110 and the support part 120 applied to the rotating part 110 or the support part 120 (S1). In the block diagrams of FIGS. 6A to 6C, the applied rotating velocity is represented by a first input value ($u_1$) and the applied moving speed is represented by a second input value ($u_2$). In this case, as described above, due to a disturbance applied to each of them, the motor 112 is applied with first input value+first disturbance value ($u_1+d_1$) and the rotating part 100 or the support part 120 is applied with second input value+second disturbance value ($u_2+d_2$). Therefore, as illustrated in the block diagrams of FIGS. 6A to 6C, the roll 111 outputs the rotating velocity (ω+Δω) with an error, not outputting the desired rotating velocity (ω) and the support part 120 outputs the movement velocity (V+ΔV) with an error, not outputting the originally desired movement velocity (V).

In addition, the roll 111 generates the radius (R+ΔR) with an error, not outputting the original radius R, due to the printing pressure to the flexible surface. Therefore, the synchronization error as much as $(R+\Delta R)(\omega+\Delta\omega)-(V+\Delta V)$ occurs.

Next, as illustrated in FIG. 7, the sensor unit 141 measures the force (F) applied in the tangential direction of the roll 111 (S2). As described above, when the synchronization error occurs, the friction force (F) is also generated. Therefore, it may be appreciated that there is a need to perform the compensation when the friction force (F) is not 0.

Next, as illustrated in FIG. 7, the control unit 142 calculates the compensation value of the rotating velocity (ω) of the motor 112 or the relative movement velocity (V) between the rotating part 110 and the support part 120 by using the value of the force measured by the sensor unit 141 and the previously stored friction model (S3). FIGS. 6A to 6C are block diagrams illustrating a process of calculating the required compensation value by adding the synchronization error $(R+\Delta R)(\omega+\Delta\omega)-(V+\Delta V)$ value to the friction model (of control unit 142).

Finally, as illustrated in FIG. 7, the control unit 142 applies the compensation value of the rotating velocity (ω) of the motor 112 calculated in the step S3 to the motor 112 or the compensation value of the relative movement velocity (V) between the rotating part 110 and the support part 120 calculated in the step S3 to the rotating part 110 or the support part 120 (S4). FIG. 6A illustrates an example in which the control unit 142 performs the compensation by applying the compensation value of the rotating velocity (ω) of the motor 112 calculated in the step S3 to the motor 112, FIG. 6B illustrates an example in which the control unit 142 performs the compensation by applying the compensation value of the relative movement velocity (V) between the rotating part 110 and the support part 120 calculated in the step S3 to the rotating part 110 or the support part 120, and FIG. 6C illustrates an example in which the control unit 142 performs the compensation by calculating the compensation values of both of the rotating velocity (ω) and the movement velocity (V) and applying the calculated compensation values to both of them.

In addition, the sensor unit 141 may further measure at least one selected from the force applied in a radial direction of the roll 111 or the force applied in an extending direction of the roll 111 among the forces applied between the roll 111 and the substrate 500. As described above, components driven to set the friction force to 0 are controlled by measuring the force applied in the tangential direction, that is, the friction force, thereby compensating for the synchronization error. Meanwhile, in addition to the synchronization error, various error occurrence factors are substantially present in the printing apparatus 100. For example, if it is assumed that the printing apparatus 100 is configured in a form illustrated in FIG. 3, when both ends of the rotating part 110 do not move at the same speed, a tilting problem of the rotating part 110 like torsion may occur. Alternatively, the roll forming the rotating part 110 may cause a bending problem, such as the sagging of a middle portion of the roll, due to a problem of a self weight, and the like. Alternatively, the alignment problem, such as the alignment of the substrate 500 is not properly made at the desired position, may occur. Other error factors as described above, for example, the tilting or the bending may be measured by a method of confirming the tilting or the bending based on a distribution of force allowing the rotating part 110 to press the support part 120, and the like. That is, when the sensor unit 141 measures only the friction force (force in the tangential direction), only the synchronization error may be compensated, but the sensor unit 141 may measure the force in the radial direction, the force in the extending direction, and the like, thereby performing the compensation of other errors together. In this case, the compensation unit 140 controls the support part 120 to further compensate for at least one selected from the tilting, the bending, and the alignment between the rotating part 110 and the support part 120.

Second Exemplary Embodiment

According to the first exemplary embodiment of the present invention, in the synchronization error compensation of the printing apparatus 100, the compensation unit 140 performs a control to compensate for the rotating velocity (ω) or the relative movement velocity (V) so that the friction force becomes 0 by using the friction force (force in the tangential direction) between the rotating part 110 and the support part 120. In this case, however, since in order to control the rotating velocity (ω), the motor 112 needs to be directly controlled and in order to control the relative movement velocity (V), the relative movement between the rotating part 110 and the support part 120 needs to be directly controlled, it may be difficult to substantially perform the direct control as described above. The considerably small amount of the synchronization error occurs. In order to perform the micro and fine operation control, the motor 112 itself or the driving unit itself, such as the actuator providing the relative movement between the rotating part 110 and the support part 120, may be required to be implemented as the high-performance product.

Figure 8:
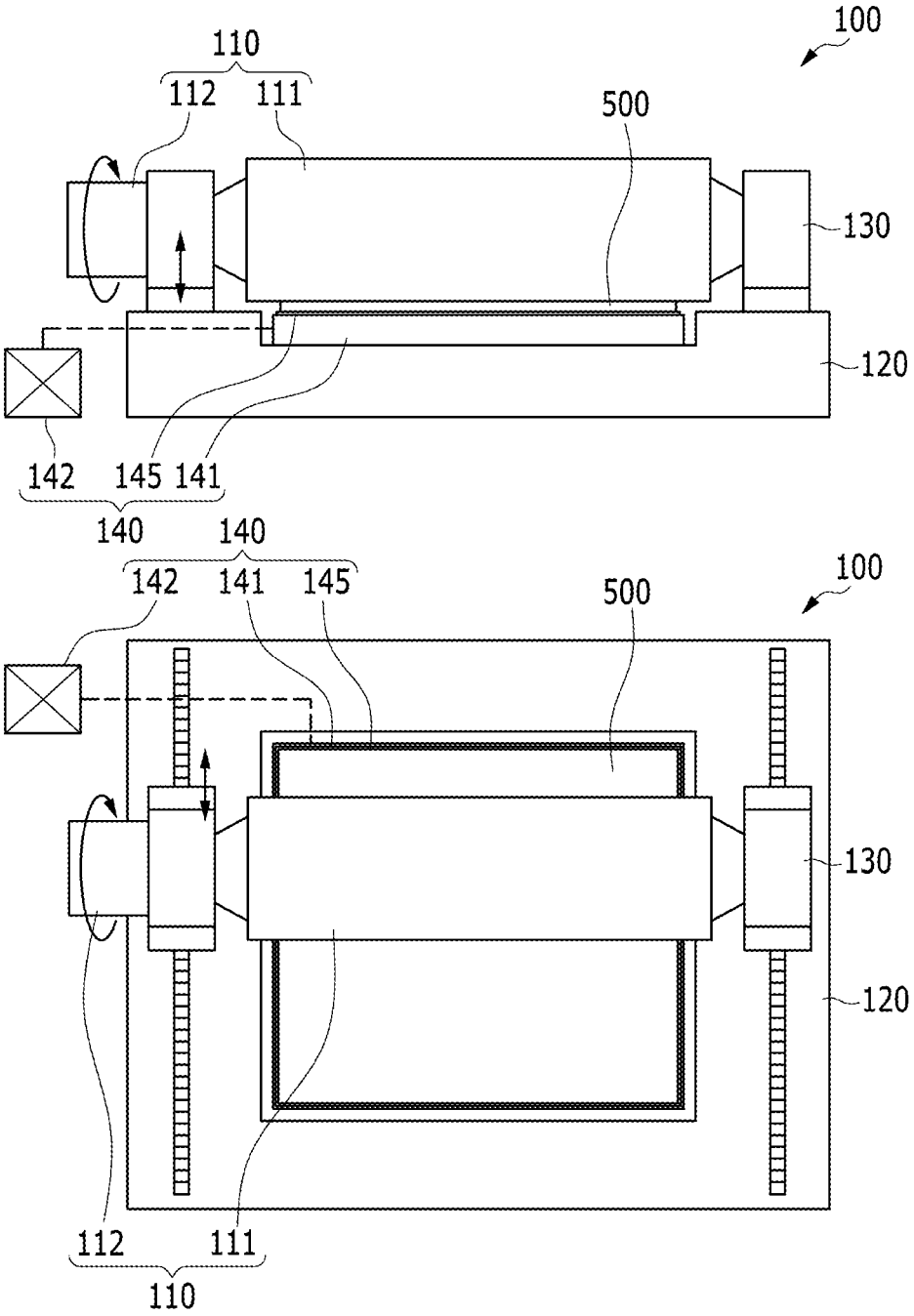
FIG. 8 is a diagram illustrating a printing apparatus according to a second exemplary embodiment of the present invention.

Considering the aspect, the printing apparatus 100 may further include an additional stage 145 which is wholly responsible for the position movement to control the synchronization error. FIG. 8 illustrates an example of the second exemplary embodiment of the present invention in which the additional stage 145 is further disposed. As illustrated in FIG. 8, according to the second exemplary embodiment of the present invention, the compensation unit 140 is configured to further include the additional stage 145 disposed on the support part 120 so that the substrate 500 is disposed over the additional stage 145. That is, according to the second exemplary embodiment of the present invention, the synchronization error may be compensated by compensating for at least one selected from the rotating velocity (ω) of the motor 112 and the relative movement velocity (V) between the rotating part 110 and the support part 120 and a displacement or a velocity of the additional stage 145. As described above, when the rotation of the motor 112, the movement of the rotating part 110, or the like is directly controlled, there may be problems in that the fine control is difficult or in order to realize the direct control, the high-performance motor or moving driving unit needs to be used and thus the cost for configuring the apparatus is increased. In this case, in the printing apparatus 100 according to the second exemplary embodiment of the present invention, the additional stage 145 is configured of a fine stage which may perform a fine position control, such that the motor 112 or the driving unit (does not have to perform the fine control) for the relative movement between the rotating part 110 and the support part 120 performs a control of a relatively large range by using a relatively low-performance product and the compensation of the finer range is performed by using the additional stage 145 configured of the fine stage, thereby more economically and easily realizing the fine compensation of the synchronization error.

Conceptually, for example, when an amount to compensate for the synchronization error is set to be 12.8, according to the exemplary embodiment of the present invention, the amount is compensated as much as 12 by the control of the motor or the driving unit for the relative movement between the rotating part and the support part and the amount is compensated as much as 0.8 by the control of the fine stage. When the compensation is performed by the method according to the first exemplary embodiment of the present invention, in this example, the motor or the driving unit for the relative movement between the rotating part and the support part has a minimum controllable range of 0.1 or less, which means the use of the high-performance component, and as a result becomes a factor of increasing the component cost. However, when the compensation is performed by the method according to the second exemplary embodiment of the present invention, in this example, the motor or the driving unit for the relative movement between the rotating part and the support part may have a minimum controllable range of about 1 and may instead have a minimum controllable range of 0.1 or less in the fine stage. Since the fine stage is used in various fields and therefore a relatively inexpensive, high-performance product may be obtained, the cost required to configure the apparatus may be reduced by implementing the motor or the driving unit for the relative movement between the rotating part and the support part as the lower-performance component rather than as the higher-performance component and further adding the fine stage.

Figure 9:
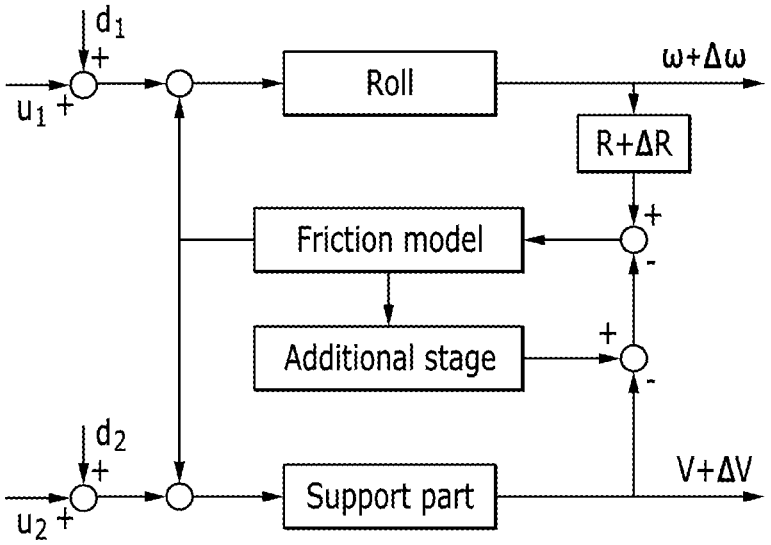
FIG. 9 is a block diagram illustrating a printing method according to a second exemplary embodiment of the present invention.

FIG. 9 illustrates a block diagram of an example of the feedback control when the additional stage 145 configured of the fine stage is further used. The example of FIG. 9 illustrates a case where the control by the additional stage 145 is further added to the feedback control of FIG. 6C. That is, this corresponds to a case of controlling all the rotating velocity, the movement velocity, and the additional stage. FIG. 9 illustrates a case in which the additional stage control is added to the feedback control of FIG. 6C, but the present invention is not limited thereto. For example, as illustrated in FIG. 6A, when the rotating velocity is subjected to the feedback control, the additional stage control may be added or as illustrated in FIG. 6B, when the movement velocity is subjected to the feedback control, the additional stage control may also be added, and the like. Therefore, the control model may be appropriately selected according to the user purpose or convenience.

In addition, like the first exemplary embodiment of the present invention, the sensor unit 141 may further measure at least one selected from the force applied in a radial direction of the roll 111 or the force applied in an extending direction of the roll 111 among the forces applied between the roll 111 and the substrate 500. In this case, the compensation unit 140 is enough to control at least one selected from the support part 120 and the additional stage 145 to further compensate for at least one selected from the tilting, the bending, and the alignment between the rotating part 110 and the support part 120.

Third Exemplary Embodiment

The third exemplary embodiment of the present invention is based on the principle of the first exemplary embodiment of the present invention or the second exemplary embodiment of the present invention as described above, but is an exemplary embodiment which may further save the cost required to configure the apparatus in an economical aspect.

In performing the feedback control as described above, in order to measure the force (that is, friction force) applied in the tangential direction of the roll 111 among the forces between the roll 111 and the substrate 500, the sensor unit 141 which may measure a shear force needs to be used. However, since most of the sensors which may finely measure the shear force are expensive, when the sensor units 141 which may measure the shear force are disposed for every printing apparatus 100, the cost of the printing apparatus 100 may be increased.

In view of the economical aspect, the sensor unit 141 does not measure the force applied in the tangential direction of the roll 111 and may be configured to measure at least one selected from the force applied in the radial direction of the roll 111 and the force applied in the extending direction of the roll 111. In particular, in the case of measuring the force applied in the radial direction of the roll 111, the simple apparatus, such as a piezoelectric sensor, may be used, and thus the cost saving effect is very large.

When the sensor unit 141 is configured as described above, the compensation unit 140 is configured to control at least one selected from the rotating velocity (ω) of the motor 112 and the relative movement velocity (V) between the rotating part 110 and the support part 120 depending on lookup table data which are previously stored in the control unit 142. In this case, the lookup table may be stored with data which represent the relationship between variables of at least two variables selected from the pressure applied by the printing pressure part 130, the radius R of the roll 111, the rotating velocity (ω) of the motor 112, an angle (θ) of the roll 111, the relative movement velocity (V) between the rotating part 110 and the support part 120, and the relative displacement (x) between the rotating part 110 and the support part 120.

The lookup table is configured of data which are obtained by using the printing apparatus performing the feedback control as described above. Therefore, at least one printing apparatus including the sensor unit which measures the force applied in the tangential direction of the roll, that is, the friction force is required. Further, when the compensation is performed using the lookup table, the previously predicted synchronization error may be compensated or the unpredicted error occurring due to the disturbance may be difficult to cope with. However, for example, when the plurality of printing apparatuses for mass production are installed, the sensor unit is installed only in the printing apparatus to prepare the lookup table in advance and the compensation control is performed only by the previously prepared lookup table without the remaining printing apparatuses including the sensor unit, such that all the printing apparatuses may not include the sensor units which may measure the friction force, thereby greatly saving the cost required to configure the entire facility. Further, one factory facility does not necessarily include only one printing apparatus including the sensor unit. The lookup table prepared in another factory facility may be used or when the apparatus is setup, the lookup table is prepared by calibration and then when the apparatus is mass produced, the so prepared lookup table may also be used. In the case of using the lookup table, it is possible to greatly save the costs required to build the facility while performing some compensation.

According to the printing apparatus and method for measuring and compensating for a synchronization error according to the exemplary embodiment of the present invention, the error occurring due to the sliding between the roll and the substrate may be greatly reduced by compensating for the synchronization error occurring between the roll and the substrate at the time of the electronic printing (in particular, due to the deformation of the roll). As described above, the related art never tries to measure or compensate for the synchronization error and therefore does not have a method for solving a problem of deterioration in printing precision occurring due to the synchronization error; however, the exemplary embodiments of the present invention compensates for the synchronization error to basically solve the problem, thereby remarkably improving the printing precision.

Meanwhile, the printing apparatus according to the exemplary embodiment of the present invention selectively measures the force in the appropriate direction and is to compensate for the synchronization error based on the measured force by using the appropriate method. In this case, the direction of the measured force or the control method may be selected and the cost required to configure the apparatus may be determined, based on how to configure the sensor unit 141. Therefore, several exemplary embodiments of the configuration of the sensor unit 141 will be described below in more detail.

[Exemplary Embodiment 1 of Sensor Unit]

Except for consideration in view of the cost aspect as described above, when the sensor unit 141 is configured of a 6-axis sensor which measures each of the axis moments, including the force applied in the tangential direction of the roll 111, the force applied in the radial direction of the roll 111, the force applied in the extending direction of the roll 111, and the like, the finest and most effective compensation control may be performed. When the sensor unit 141 measures all forces in various directions, the compensation model may be more delicately made by considering the friction force between the roll 111 and the substrate 500 and various factors (that is, bending, tilting, alignment, and the like as described above), such as the bending or tilting of the roll 111, horizontal matching of the substrate 500, and the like, such that the printing precision may be maximized.

[Exemplary Embodiment 2 of Sensor Unit]

The most essential condition to be included in the sensor unit 141 is the very measurement of the force applied in the tangential direction of the roll 111. In this case, when the sensor unit 141 may measure only the force applied in the tangential direction, the sensor unit 141 may be implemented in more inexpensive and various manners.

In this case, the sensor unit 141 is configured to include a guide part which is connected to the support part 120 so as to have the substrate 500 disposed thereon and is allowed to move only in a direction parallel with the relative movement direction between the rotating part 110 and the support part 120 and a measurement part 144 which is configured to include a displacement sensor or a load cell which is disposed at an end parallel with the movement direction of the guide part to measure the value of the displacement or the force depending on the movement of the guide part.

As described above, when the guide part is disposed, the substrate 500 moves due to the friction force (since the guide part guides the substrate 500 to move only in the friction force direction as described above under the condition that the friction force is substantially generated between the roll 111 and the substrate 500. Therefore, in this case, the measurement part 144 is pushed by the guide part, such that the value of the displacement or the force other than 0 is measured and the compensation is performed to make the value of the displacement or the force become 0, such that the compensation of the synchronization error may be performed. In addition, the guide part is deformed due to the friction force at the time of the occurrence of the synchronization error, and thus the guide part itself moves a portion of the substrate 500, which naturally leads to the effect of compensating for the synchronization error. That is, the guide part is disposed so that the synchronization error in the large range may be naturally compensated for by the guide part and the fine compensation is performed by the sensor unit 141 and the control unit 142 so that the printing precision by the printing apparatus 100 may be maximized.

The actually implementable structure of the sensor unit 141 having the form as described above will be described with reference to several exemplary embodiments of the present invention. The guide part may have a flexure structure or a rolling bearing structure. The flexure structure is a terminology generally referring to a structure which may be deformed only in any one direction and may not be deformed in the remaining directions, as described above.

Figure 10A:
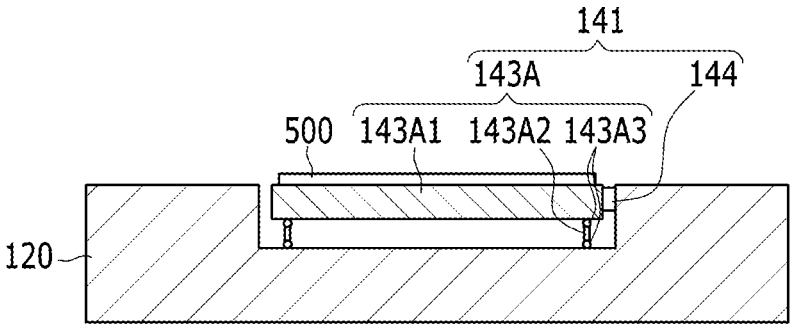
FIGS. 10A to 10D are diagrams illustrating several examples of a guide part according to the exemplary embodiment of the present invention.
Figure 10B:
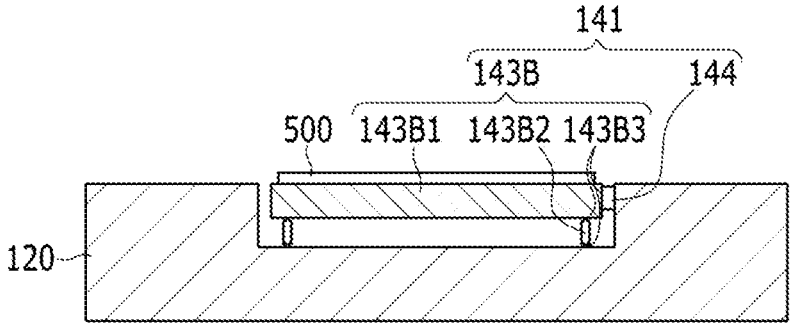
Figure 10C:
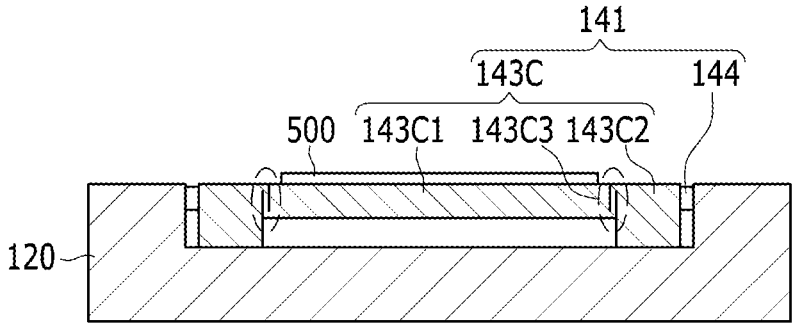
Figure 10D:
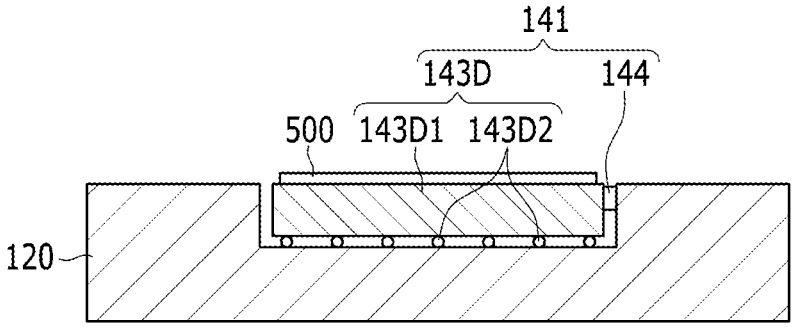

FIGS. 10A to 10D illustrate several exemplary embodiments (exemplary embodiments 2A to 2D) of the present invention of the guide part in the [Exemplary Embodiment 2 of Sensor Unit]. FIGS. 10A to 100 illustrate exemplary embodiments of the present invention in the case in which the guide part has the flexure structure and FIG. 10D illustrates an exemplary embodiment of the present invention in the case in which the guide part has the rolling bearing structure.

FIG. 10A illustrates a detailed structure of a guide part 143A of the exemplary embodiment 2A. In the exemplary embodiment 2A, the guide part 143A is configured to include a disposition part 143A1 having the substrate 500 disposed thereon, a link part 143A2 disposed at a lower end of the disposition part 143A1 to connect the disposition part 143A1 to the support part 120, and a hinge part 143A3 disposed at a point which the link part 143A2 is connected to the disposition part 143A1 or the support part 120 and formed to rotate in a direction parallel with the relative movement direction between the rotating part 110 and the support part 120. That is, since the rotation direction of the hinge part 143A3 is fixed in one direction, the disposition part 143A1 is configured to move only in the direction parallel with the relative movement direction between the rotating part 100 and the support part 120 and not to move in the remaining directions.

FIG. 10B illustrates a detailed structure of a guide part 143B of the exemplary embodiment 2B. In the exemplary embodiment 2A, the guide part 143B is configured to include a disposition part 143B1 having the substrate 500 disposed thereon, a link part 143B2 disposed at a lower end of the disposition part 143B1 to connect the disposition part 143B1 to the support part 120, and a notch part 143B3 disposed at a point which the link part 143B2 is connected to the disposition part 143B1 or the support part 120 and formed to be depressed in a direction parallel with the relative movement direction between the rotating part 110 and the support part 120. By the notch part 143B3, upper and lower ends of the link part 143B2 may be easily deformed elastically in a warpage direction due to the external force and as described above, may realize a motion which satisfies a motion condition of the guide part.

FIG. 10C illustrates a detailed structure of a guide part 143C of the exemplary embodiment 2C. In the exemplary embodiment 2C, the guide part 143C is configured to include a disposition part 143C1 having the substrate 500 disposed thereon, a plurality of connection parts 142C2 fixedly disposed on the support part 120, and a plate spring part 143C3 disposed at a point which the disposition part 143C1 is connected to the connection part 142C2 and formed to be bent in a direction parallel with the relative movement direction between the rotating part 110 and the support part 120. According to the structural characteristics of the plate spring part 143C itself, the guide part 143C of exemplary embodiment 2C may also realize a motion which satisfies a motion condition of the guide part as described above.

FIG. 10D illustrates a detailed structure of a guide part 143D of the exemplary embodiment 2D. The exemplary embodiment 2D is an example in which the guide part has the rolling bearing structure as described above and in the exemplary embodiment 2D, the guide part 143D is configured to include a disposition part 143D1 having the substrate 500 disposed thereon and a rolling bearing 143D2 disposed between the support part 120 and the disposition part 143D1. A rolling bearing 143D2 is also configured to allow only the movement in the friction force direction and may realize a motion which satisfies the motion condition of the guide part as described above.

Figure 11A:
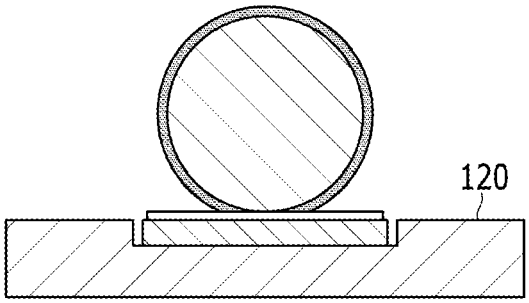
FIGS. 11A to 11C are diagrams illustrating several examples of a form of a support part.
Figure 11B:
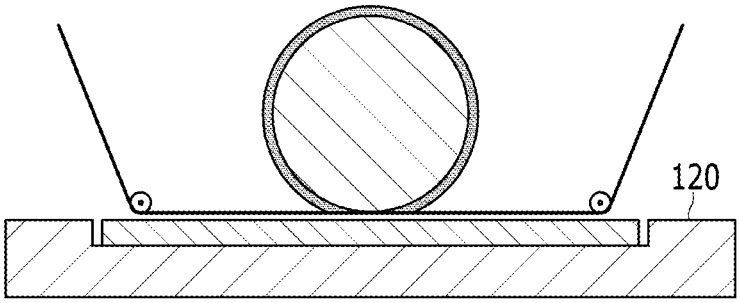
Figure 11C:
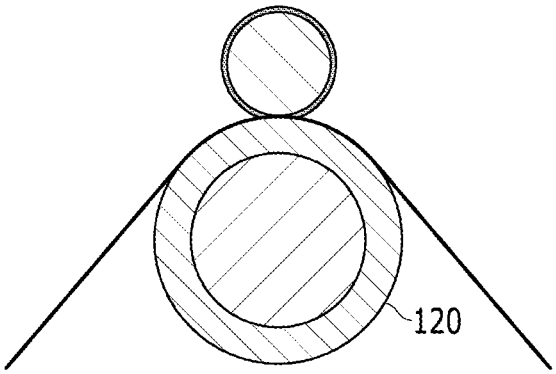

In addition, the foregoing drawings illustrate that the support part 120 has a flat type stage form supporting the flat type substrate, but the present invention is not limited thereto. FIGS. 11A to 110 illustrate several examples of the support part form, in which FIG. 11A illustrates the case in which the support part 120 has a flat type stage form supporting the flat type substrate, FIG. 11B illustrates the case in which the support part 120 has the flat type stage form supporting the flexible substrate, and FIG. 11C illustrates the case in which the support part 120 has a roll form supporting the flexible substrate. As described above, the support part 120 may be selectively used appropriately according to a kind of the substrate and thus the form of the sensor unit 141 may also have a design appropriately changed to meet thereto. In the foregoing examples, various exemplary embodiments of the sensor unit 141 have an appropriate form for the flat type stage supporting the flat type substrate as illustrated in FIG. 11A, but all the exemplary embodiments of the present invention may be properly applied to the flat type stage supporting the flexible substrate as illustrated in FIG. 11B. Therefore, it is to be noted that the technology of the present invention disclosed in the exemplary embodiments of the present invention may be applied to the flat type substrate, the flexible substrate, or the like.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

<Description of symbols>

| | |
|---|---|
| 100: Printing apparatus (of the present invention) | 110: Rotating part |
| 111: Roll | 112: Motor |
| 120: Support part | 130: Printing pressure part |
| 140: Compensation unit | 141: Sensor unit |
| 142: Control unit | 143: Guide part |

143A: Exemplary embodiment 2A of guide part
143A1: Disposition part (of exemplary embodiment 2A of guide part) dispose
143A2: Link part (of exemplary embodiment 2A of guide part)
143A3: Hinge part (of exemplary embodiment 2A of guide part)
143B: Exemplary embodiment 2B of guide part
143B1: Disposition part (of exemplary embodiment 2B of guide part)
143B2: Link part (of exemplary embodiment 2B of guide part)
143B3: Notch part (of exemplary embodiment 2B of guide part)
143C: Exemplary embodiment 2C of guide part
143C1: Disposition part (of exemplary embodiment 2C of guide part)
143C2: Connection part (of exemplary embodiment 2C of guide part)
143C3: Plate spring part (of exemplary embodiment 2C of guide part)
143D: Exemplary embodiment 2D of guide part
143D1: Disposition part (of exemplary embodiment 2D of guide part)
143D2: Rolling bearing (of exemplary embodiment 2D of guide part)
144: Measurement part
145: Additional stage

What is claimed is:

1. A printing apparatus for measuring and compensating for a synchronization error, comprising:

a rotating part configured to include a roll of which the surface is made of a flexible material and a motor rotating the roll;

a support part having a substrate disposed on an upper portion thereof to support the substrate and formed to relatively move in a direction parallel with a tangential direction of the rotating part and the roll;

a printing pressure part formed to provide adhesion and printing pressure of the roll to the substrate by changing an interval between the rotating part and the support part; and a compensation unit configured to include a sensor unit which is disposed on a lower portion of the substrate to measure forces which are applied between the roll and the substrate at a contact position between the roll and the substrate and a control unit which performs a control to compensate for the synchronization error by using values of forces measured by the sensor unit.

2. The printing apparatus of claim 1, wherein: the sensor unit measures a force applied in a tangential direction of the roll among the forces applied between the roll and the substrate.

3. The printing apparatus of claim 2, wherein the compensation unit performs the control by compensating for at least one selected from a rotating velocity (ω) of the motor and a relative movement velocity (V) between the rotating part and the support part.

4. The printing apparatus of claim 3, wherein the compensation unit performs a feedback control on at least one selected from the rotating velocity (ω) of the motor and the relative movement velocity (V) between the rotating part and the support part so that the force applied in the tangential direction of the roll becomes 0.

5. The printing apparatus of claim 2, wherein the sensor unit further measures at least one selected from a force applied in a radial direction of the roll and a force applied in an extending direction of the roll among the forces applied between the roll and the substrate.

6. The printing apparatus of claim 5, wherein the compensation unit controls the support part to further compensate for at least one selected from tilting, bending, and alignment between the rotating part and the support part.

7. The printing apparatus of claim 2, wherein the compensation unit is configured to further include an additional stage which is disposed on the support part so as to have the substrate disposed on an upper portion thereof.

8. The printing apparatus of claim 7, wherein the compensation unit performs the control by compensating for at least one selected from the rotating velocity (ω) of the motor and the relative movement velocity (V) between the rotating part and the support part and a displacement or a velocity of the additional stage.

9. The printing apparatus of claim 7, wherein the sensor unit further measures at least one selected from a force applied in a radial direction of the roll and a force applied in an extending direction of the roll among the forces applied between the roll and the substrate.

10. The printing apparatus of claim 9, wherein the compensation unit controls at least one selected from the support part and the additional stage so as to further compensate for at least one selected from the tilting, the bending, and the alignment between the rotating part and the support part.

11. The printing apparatus of claim 1, wherein the sensor unit measures at least one of the force applied in the radial direction of the roll and the force applied in the extending direction of the roll among the forces applied between the roll and the substrate.

12. The printing apparatus of claim 11, wherein the compensation unit controls at least one selected from the rotating velocity (ω) of the motor and the relative movement velocity (V) between the rotating part and the support part depending on lookup table data which is previously stored in the control unit.

13. The printing apparatus of claim 12, wherein the lookup table is stored with data which represent the relationship between variables of at least two variables selected from a pressure applied by the printing pressure part, a radius (R) of the roll, the rotating velocity (ω) of the motor, an angle (θ) of the roll, the relative movement velocity (V) between the rotating part and the support part, and a relative displacement (x) between the rotating part and the support part.

14. The printing apparatus of claim 1, wherein the sensor unit is configured of a 6-axis sensor.

15. The printing apparatus of claim 1, wherein the sensor unit includes:

a guide part connected to the support part so as to have the substrate disposed thereon and allowed to move only in a direction parallel with a relative movement direction between the rotating part and the support part; and a measurement unit configured to include a displacement sensor or a load cell which is disposed at an end parallel with a movement direction of the guide part to measure a value of a displacement or a force depending on the movement of the guide part.

16. The printing apparatus of claim 15, wherein the guide part has a flexure structure or a rolling bearing structure.

17. The printing apparatus of claim 16, wherein the guide part configured to include a disposition part having the substrate disposed thereon, a link part disposed at a lower end of the disposition part to connect the disposition part to the support part, and a hinge part disposed at a point which the link part is connected to the disposition part or the support part and formed to rotate in a direction parallel with the relative movement direction between the rotating part and the support part.

18. The printing apparatus of claim 16, wherein the guide part configured to include a disposition part having the substrate disposed thereon, a link part disposed at a lower end of the disposition part to connect the disposition part to the support part, and a notch part disposed at a point which the link part is connected to the disposition part or the support part and formed to be depressed in a direction parallel with the relative movement direction between the rotating part and the support part.

19. The printing apparatus of claim 16, wherein the guide part configured to include a disposition part having the substrate disposed thereon, a plurality of connection parts fixedly disposed on the support part, and a plate spring part disposed at a point which the disposition part is connected to the connection part and formed to be bent in a direction parallel with the relative movement direction between the rotating part and the support part.

20. The printing apparatus of claim 16, wherein the guide part configured to include a disposition part having the substrate disposed thereon and a rolling bearing disposed between the support part and the disposition part.

21. The printing apparatus of claim 1, wherein the support part is formed in at least one selected from a flat type stage form supporting a flat type substrate, a roll form supporting a flexible substrate, and a flat type stage form supporting the flexible substrate.

22. A printing method for measuring and compensating for a synchronization error using a printing apparatus configured to include a rotating part including a roll and a motor, a support part having a substrate disposed on an upper portion thereof to support the substrate, a printing pressure part changing an interval between the rotating part and the support part, and a compensation unit including a sensor unit which is disposed on a lower portion of the substrate to measure a force in at least one direction applied in a tangential direction of the roll among forces which are applied between the roll and the substrate at a contact position between the roll and the substrate and a control unit which controls at least one selected from a rotating velocity (ω) of the motor and a relative movement velocity (V) between the rotating part and the support part to compensate for the synchronization error using a value of the force measured by the sensor unit, the printing method comprising:

performing a feedback control on at least one selected from the rotating velocity (ω) of the motor and the relative movement velocity (V) between the rotating part and the support part so that the force applied in the tangential direction of the roll becomes 0.

23. The printing method of claim 22, comprising the steps of:

(S1) receiving, the control unit, at least one selected from the rotating velocity (ω) of the motor applied to the motor and the relative movement velocity (V) between the rotating part and the support part applied to the rotating part or the support part;

(S2) measuring, by the sensor unit, a force F applied in the tangential direction of the roll;

(S3) calculating, by the control unit, the compensation value of the rotating velocity (ω) of the motor or the relative movement velocity V between the rotating part and the support part by using a value of the force measured by the sensor unit and a previously stored friction model; and (S4) applying the compensation value of the rotating velocity (ω) of the motor calculated in the step S3 to the motor or the compensation value of the relative movement velocity (V) between the rotating part and the support part calculated in the step S3 to the rotating part or the support part, by the control unit.

* * * * *